US011242608B2

(12) United States Patent
Buratti

(10) Patent No.: US 11,242,608 B2
(45) Date of Patent: Feb. 8, 2022

(54) ELECTROLYTIC PROCESSES FOR COATING METAL SURFACES TO PROVIDE HIGH RESISTANCE TO CORROSION AND ABRASION

(71) Applicant: Metalcoating S.r.l., Milan (IT)

(72) Inventor: Marco Buratti, Milan (IT)

(73) Assignee: METALCOATING S.R.L., Milan (IT)

( * ) Notice: Subject to any disclaimer, the term of this patent is extended or adjusted under 35 U.S.C. 154(b) by 0 days.

(21) Appl. No.: 16/630,261

(22) PCT Filed: Jul. 13, 2018

(86) PCT No.: PCT/IB2018/055197
§ 371 (c)(1),
(2) Date: Jan. 10, 2020

(87) PCT Pub. No.: WO2019/012496
PCT Pub. Date: Jan. 17, 2019

(65) Prior Publication Data

US 2021/0095387 A1 Apr. 1, 2021

(30) Foreign Application Priority Data

Jul. 14, 2017 (IT) ..... 102017000079843

(51) Int. Cl.
*C25D 3/56* (2006.01)
*C25D 3/12* (2006.01)
*C25D 15/00* (2006.01)

(52) U.S. Cl.
CPC ..... *C25D 3/562* (2013.01); *C25D 3/12* (2013.01); *C25D 15/00* (2013.01)

(58) Field of Classification Search
None
See application file for complete search history.

(56) References Cited

U.S. PATENT DOCUMENTS 6,355,154 B1 * 3/2002 Buratti ..... B31F 1/2863 205/109
2013/0168259 A1 * 7/2013 Kurrle ..... C25D 3/12 205/271
2017/0009350 A1 * 1/2017 Myllymaki ..... C23C 18/38

FOREIGN PATENT DOCUMENTS

EP 0737656 B1 * 8/2000 ..... C04B 35/63424
EP 1067220 A2 1/2001
(Continued)

OTHER PUBLICATIONS

International Search Report and Written Opinion in International Application No. PCT/IB2018/055197 dated Oct. 8, 2018, 11 pages.
(Continued)

*Primary Examiner* — Louis J Rufo
(74) *Attorney, Agent, or Firm* — MH2 Technology Law Group, LLP

(57) ABSTRACT

A process for coating a metal article may include: preparing an electrolytic bath including a suspension of boron carbide particles in an aqueous solution including: at least one nickel (II) salt; and at least one phosphorous compound selected from: phosphoric acid, phosphorous acid, hypophosphorous acid, or their salts; and immersing, in the electrolytic bath, a cathode and an anode, and carrying out electrodeposition by passing direct current in the electrolytic bath. The cathode may include the metal article to be coated. The boron carbide particles may have an average size greater than or equal to 0.01 micron (μm) and less than or equal to 2 μm. The boron carbide particles may have been pretreated with at least one carboxylic acid or a derivative thereof. The at least one carboxylic acid or the derivative thereof may have a solubility in water at 20° C. greater than 0.10 grams/liter.

20 Claims, 2 Drawing Sheets

(56) References Cited

FOREIGN PATENT DOCUMENTS

Figure 1:
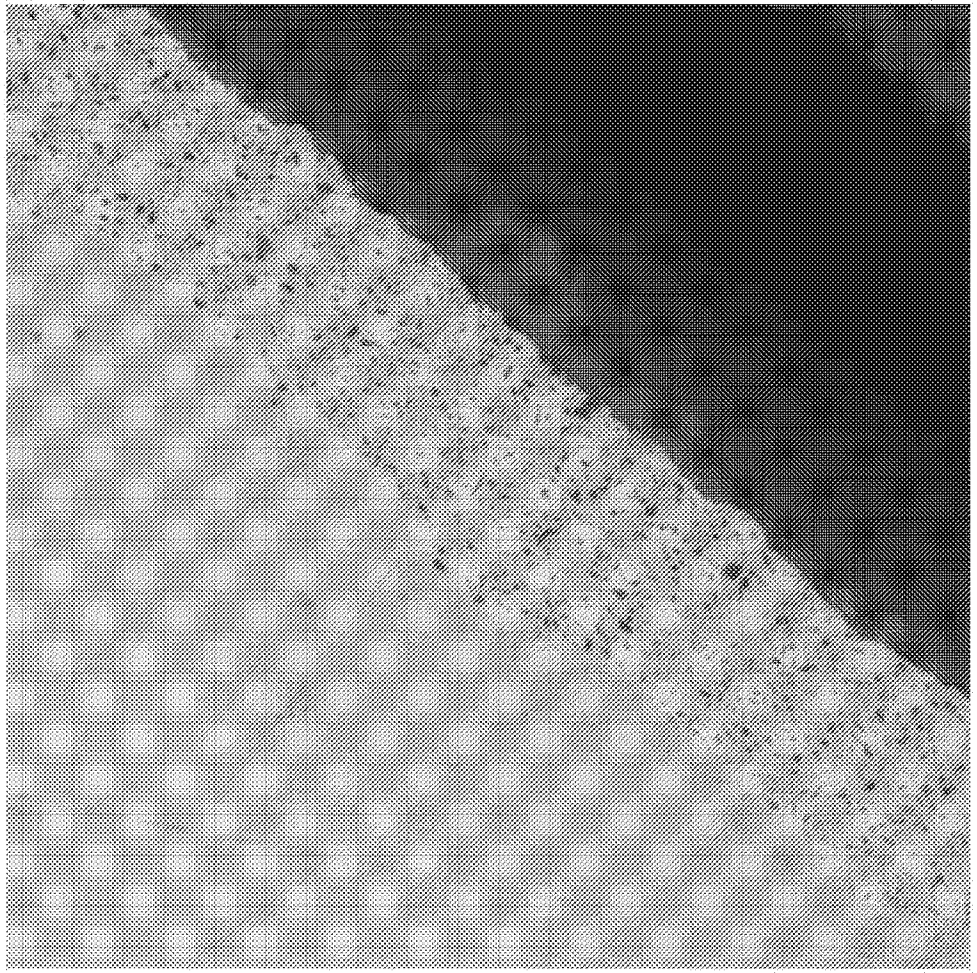

| | | | |
|---|---|---|---|
| EP | 3098334 | A1 | 11/2016 |
| WO | 2002052063 | A1 | 7/2002 |

OTHER PUBLICATIONS

"A Guidebook to Particle Size Analysis", HORIBA Instruments, Inc., 2012, 32 pages.

* cited by examiner

ELECTROLYTIC PROCESSES FOR COATING METAL SURFACES TO PROVIDE HIGH RESISTANCE TO CORROSION AND ABRASION

CROSS-REFERENCE TO RELATED APPLICATION(S)

This application is a national stage entry from International Application No. PCT/IB2018/055197, filed on Jul. 13, 2018, in the Receiving Office ("RO/IB") of the International Bureau of the World Intellectual Property Organization ("WIPO"), published as International Publication No. WO 2019/012496 A1 on Jan. 17, 2019; International Application No. PCT/IB2018/055197 claims priority under 35 U.S.C. § 119 from Italian Patent Application No. 102017000079843, filed on Jul. 14, 2017, in the Italian Patent and Trademark Office ("IPTO"), the entire contents of all of which are incorporated herein by reference.

The present invention relates to an electrolytic process for coating metal surfaces. More in particular, the present invention relates to an electrolytic process for coating metal surface with a layer comprising a nickel/phosphorus alloy and boron carbide particles, to provide high resistance against corrosion and abrasion.

There is a very pressing need to produce metal articles having high resistance against surface wear, combined with high corrosion resistance, such as in particular steel rods and tubes to be used in different sectors, for example for the production of industrial or agricultural vehicle, forklifts, presses, robotics, elevators, hydraulic platforms, or also for special applications where high corrosion resistance is required even in extremely severe conditions, such as earth-moving machines, excavators, dredgers, salt spreading machines, snowploughs, waste compactors, zootechnics machines, cranes, cableways and ski lifts, watercraft, off-shore platforms, aircraft, space vehicles, etc.

Corrosion resistance is generally assessed through accelerated aging tests in a saline fog chamber, which can be conducted according to different international standards, in particular the ISO 9227:2017 standard. These tests are generally performed in more aggressive conditions than those expected in operation, to accelerate corrosive processes and reduce the duration of the tests, which normally last from a few tens to a few hundreds of hours.

In general, to obtain the desired combination of wear resistance and corrosion resistance, coatings of metal articles are carried out conventionally by means of nickel plating and subsequent chrome plating, i.e. electrolytic deposition of a layer of nickel and subsequently of a layer of chromium, so as to obtain a layer of coating with total thickness of the order of 100 μm. While chrome plating has low costs, it does not always allow to obtain highly uniform coatings, especially in case of surfaces with complex geometry (for example grooves or other deep etches) in which, because of the tip effect, excessive thickness levels are obtained on the tips and poor thickness levels are obtained in the troughs of the etches. Moreover, the use of hexavalent chromium presents serious problems from the viewpoint of environmental sustainability, because of the high toxicity of this metal, in addition to entailing high costs in terms of energy and disposal.

In recent years, several metal coating processes have been proposed that do not require the use of products containing chromium.

For example, the patent application EP 1 067 220 A2 describes a process for obtaining a coating with boron carbide in nickel phosphorus matrix, in which the article to be coated is subjected to electrodeposition in an electrolytic bath comprising two or more nickel salts, in particular a mixture of nickel sulphate and nickel chloride, at least one complexing agent, at least one phosphorus salt, an anti-tensioning agent and boron carbide in the form of powder, having a particle dimension from 3 to 6 μm. The cathode consists of the material to be coated, while the anode consists of electrolytic nickel. The electrolytic process is carried out at a temperature from 40° C. to 70° C. with a current density from 1 to 10 A/dm$^2$, under agitation. The article thus coated is then subjected to a heat treatment, in particular at a temperature from 250° C. to 400° C.

The patent application EP 3 098 334 A1 describes a process for coating a metal article, in which the electrodeposition of boron carbide in a nickel/phosphorus alloy matrix is obtained by means of an electrolytic bath containing at least one surfactant, which allows to deposit a significant quantity of boron carbide particles having an average size from 0.01 μm to 2 μm, in general from 10% to 50% by volume, preferably from 5% to 45% by volume, with respect to the total volume of the coating. The coating layer thus obtained is provided with very high wear resistance, even at high temperatures, and high hardness (up to 1500 HV), and at the same time high thickness uniformity.

The Applicant thus addressed the problem of producing metal articles having high surface wear resistance combined with high corrosion resistance, by electrodeposition on the metal of a coating layer that is able to impart these properties without the use of chromium.

These and additional objectives that will be better illustrated hereafter have been achieved by the Applicant by means of a process as defined in the remainder of the description and in the appended claims, which allows to obtain a coating layer comprising a nickel/phosphorus (Ni/P) alloy matrix and boron carbide particles having average size from 0.01 μm to 2 μm, having corrosion resistance at least equal to 400 hours, preferably at least equal to 600 hours, of exposure to neutral saline fog, in accordance with the ISO 9227:2017 standard.

In a first aspect, the present invention therefore relates to a process for coating a metal article, which comprises:

preparing an electrolytic bath which comprises a suspension of boron carbide particles, having an average size ranging from 0.01 μm to 2 μm, preferably from 0.05 μm to 1 μm, in an aqueous solution comprising:

at least one nickel (II) salt;

at least one phosphorous compound selected from: phosphoric acid, phosphorous acid, hypophosphorous acid or their salts;

immersing, in the electrolytic bath, a cathode which comprises the article to be coated, and an anode, and carrying out an electrodeposition by passing a direct current in the electrolytic bath;

wherein the boron carbide particles have been pre-treated with at least one carboxylic acid or a derivative thereof, having a solubility in water at 20° C. higher than 0.10 g/l.

Preferably, said at least one carboxylic acid or a derivative thereof has a solubility in water at 20° C. higher than 10 g/l.

Preferably, said at least one carboxylic acid or a derivative thereof is selected from:

(i) aliphatic and/or aromatic $C_1$-$C_8$ mono-carboxylic acids, possibly mono- or poly-hydroxylated, for example: formic acid, acetic acid, propionic acid, butyric acid, valerianic acid, capronic acid, enantic acid, caprylic acid, nonanoic acid, capric acid, acrylic acid, methacrylic acid;

(ii) aliphatic and/or aromatic $C_1$-$C_{12}$ di-carboxylic acids, possibly mono- or poly-hydroxylated, for example: oxalic acid, adipic acid, phthalic acid, azelaic acid, sebacic acid, tartaric acid, aldaric acid;

or derivatives thereof.

The term "derivatives" means for example salts (in particular salts of alkaline or alkaline-earth metals), esters, amides, anhydrides.

In a preferred embodiment, the boron carbide particles have been pre-treated with a mixture of tartaric acid and acrylic acid. Preferably, in said mixture the weight ratio between tartaric acid and acrylic acid ranges from 0.2 to 5, more preferably from 0.5 to 2, still more preferably 1.

The boron carbide particles have an average size ranging from 0.01 μm to 2 μm, preferably from 0.05 μm to 1 μm.

Within the present description and the appended claims, the term "average particle size" means, unless otherwise indicated, the diameter d50 (median value) i.e. the value of the diameter below which 50% by weight of the population of particles is located (see "A Guidebook to Particle Size Analysis" published by Horiba Instruments Inc. —2016, available at https://www.horiba.com/fileadmin/uploads/Scientific/eMag/PSA/Guidebook/pdf/PSA_Guidebook .pdf). The diameter d50 can be determined by laser diffraction technique, according to ISO 13320:2009, or by analysing electronic microscope images (TEM or SEM).

The pretreatment step of the boron carbide particles with at least one carboxylic acid or a derivative thereof as defined above is preferably carried out by suspending the boron carbide particles in water and adding said at least one carboxylic acid or a derivative thereof to the suspension thus obtained. The suspension thus supplemented is preferably maintained at a temperature from 30° C. to 90° C., more preferably from 40° C. to 80° C., for a time that can vary within broad limits, preferably from 20 min and 120 min, more preferably between 40 min and 80 min.

Preferably, said at least one carboxylic acid or a derivative thereof is added to the suspension of boron carbide particles in an amount ranging from 1% by weight to 40% by weight, more preferably from 5% by weight to 30% by weight, with respect to the weight of the boron carbide particles.

In this pretreatment step the boron carbide particles are preferably maintained under stirring, for example by means of a blade mixer. Preferably, the pretreatment, after the addition of the carboxylic acid, comprises a step of sonication with ultrasound, which is carried out at a pH value of from 1 to 4, more preferably equal to 2.

Once the pretreatment is completed, to the suspension of boron carbide it is possible to add the other components of the electrolytic bath.

In a preferred embodiment, the boron carbide particles are previously purified, before the pretreatment with at least one carboxylic acid. The main purpose of the purification is to eliminate or otherwise significantly reduce the presence of polluting elements that are commonly present in boron carbide, such as ions of aluminium, chromium, copper, iron, manganese, vanadium, calcium, strontium, which can alter the final characteristics of the coating and impair its characteristics, in particular with regard to corrosion resistance. The Applicant has noted that the elimination or otherwise the reduction of these metallic pollutants allows to obtain a more compact coating with improved corrosion resistance. Purification of the boron carbide particles can be carried out according to conventional methods, for example by electrodialysis.

The boron carbide particles in suspension are present in a quantity preferably from 1 g/l to 20 g/l, more preferably from 5 to 15 g/l.

Preferably, the aqueous solution comprises at least one Ni(II) salt having a sulphur-containing anion, for example nickel (II) sulphate. More preferably, it is nickel (II) sulphamate ($Ni(SO_3NH_2)_2$). Use of nickel (II) sulphamate is particularly preferred because it allows to increase the electrodeposition rate, with a substantial improvement in terms of productivity and cost of the process.

Alternatively or additionally to the Ni(II) salt having a sulphur-containing anion, the aqueous solution can comprise at least another Ni(II) salt, selected preferably from: nickel (II) carbonate, nickel (II) acetate. It is also possible to use nickel (II) chloride, although it is not particularly preferred when the cathode is a nickel cathode, because the presence of chloride ions leads to a consumption of the nickel electrode due to anodic attack, with consequent increase in nickel concentration in the electrolytic bath, altering in a way that is difficult to control the ratios between nickel and the other components (in particular phosphorus).

Preferably, the aqueous solution comprises Ni(II) ions in a total concentration ranging from 0.3 moles/l to 3.0 moles/l, more preferably from 0.5 moles/l to 1.5 moles/l.

Preferably, the aqueous solution comprises a Ni(II) salt having a sulphur-containing anion, and a second salt selected from nickel (II) carbonate and nickel (II) acetate, the concentration of the first salt being between 0.3 moles/l and 1.8 moles/l, more preferably between 0.5 moles/l and 1.4 moles/l; the concentration of the second salt being between 0.02 moles/l and 1.0 moles/l, more preferably between 0.05 moles/l and 0.6 moles/l.

With regard to the phosphorous compound, it is selected from: phosphoric acid, phosphorous acid, hypophosphorous acid or their salts. As salts, the following can be used for example: alkali metal (for example potassium, sodium) or alkaline-earth metal (for example magnesium, calcium) salts.

According to a preferred aspect, the phosphorous compound is a mixture of phosphorous acid/hypophosphorous acid, or their salts, preferably in a weight ratio ranging from 0.8:1 to 1.2:1. This mixture is deemed to allow to further improve the characteristics of the final coating, obtaining a Ni/P alloy having a quantity of phosphorus between 13% and 16% by weight, to which is accompanied an optimal compromise between crystalline phase and amorphous phase in the coating material and hence between hardness and corrosion resistance thereof.

The quantity of phosphorus compound to be added to the electrolytic bath is selected mainly according to the type of nickel/phosphorus alloy to be obtained, i.e. a so-called "low phosphorus" alloy, i.e. in general with a quantity of phosphorus from 1 to 8% by weight, extremes included (with respect to the weight of the Ni/P alloy), or a so-called "high phosphorus" alloy, i.e. in general with a quantity of phosphorus higher than 8% and lower than or equal to 16% by weight (with respect to the weight of the Ni/P alloy). Obtaining a high phosphorus nickel/phosphorus alloy allows to further increase the corrosion resistance of the coating, in particular resistance to corrosion due to contact with water having a high salt content, for example sea water. On the other hand, a low phosphorus nickel/phosphorus alloy has lower corrosion resistance, but it is characterised by greater hardness with respect to a high phosphorus alloy.

According to a preferred aspect, the aqueous solution comprises at least one alkali metal iodide, preferably potassium iodide. The presence of iodide in the electrolytic bath is deemed to allow to further improve the corrosion resistance of the coating, in particular resistance to corrosion in saline fog, a particular severe test for any material. Preferably, the alkali metal iodide is present in the solution in a quantity between 0.1 and 10 g/l, more preferably between 0.5 and 3 g/l.

Although it is not strictly necessary, the aqueous solution may comprise at least one surfactant, as described in the patent application EP 3 098 334 A1. Preferably, the surfactant is a cationic, non-ionic or amphoteric surfactant. The concentration of said at least one surfactant in the aqueous solution is preferably between 0.01 g/l and 2 g/l, more preferably between 0.05 g/l and 1 g/l.

The aqueous solution preferably has a pH ranging from 0.5 to 4, more preferably from 1.5 to 3. To obtain values of pH within the intervals indicated above, a strong acid, in particular an aqueous solution of sulphuric acid, is preferably added to the aqueous solution. In some cases, to maintain the pH within the selected range, adding a buffering agent may be advantageous, for example a boric acid/borate or acetic acid/acetate system.

With regard to the procedure for carrying out the electrochemical process according to the present invention, it can be achieved according to conventional procedures, provided that a constant and homogeneous movement of the electrolytic bath is assured, mainly for the purpose of maintaining the boron carbide particles in suspension but without causing perturbations in the electrolytic deposition process. In particular, it is appropriate to prevent the formation of preferential ways for the flow of the suspension within the electrolytic bath, which could cause lack of homogeneity in the coating layer.

For this purpose, it is particularly advantageous to carry out the process according to the present invention in an apparatus that comprises an electrolytic tank and a system for recirculating the electrolytic bath, as described in the patent application EP 3 098 334 A1.

The electrodeposition step of the process in accordance with the present invention can be accomplished within a broad temperature range, in general from 50° C. to 95° C., preferably from 65° C. to 85° C. Lower temperatures than the aforesaid ranges would entail a reduced efficiency of the electrodeposition, while higher temperatures would have the disadvantage of an excessive evaporation of the electrolytic bath, with consequent inefficiency from the energy viewpoint.

The electrolytic bath preferably has a pH value from 1 to 5, more preferably from 1.5 to 3.

Into the electrolytic bath is immersed the metal article to be coated, which serves as cathode, and an anode, preferably an insoluble anode, for example an anode made of titanium coated with platinum or coated with mixed oxides, or a soluble anode, for example a nickel anode.

The passage of current necessary to carry out the electrodeposition process is obtained thanks to the connection of the electrodes with a direct current generator, so as to obtain a current density in the electrolytic bath generally between 0.5 and 20 A/dm$^2$, preferably between 1 and 10 A/dm$^2$.

The electrodeposition is carried out for a time which is such as to obtain the desired coating thickness, which generally ranges from 5 μm to 200 μm, more preferably from 10 μm to 75 μm.

After electrodeposition, the article thus coated may be possibly subjected to a heat treatment, at a temperature generally included between 250° C. and 400° C., preferably between 300° C. and 375° C., for a time that is variable within wide limits, for example between 1 and 24 hours, preferably between 6 and 18 hours. The heat treatment has mainly the purpose of forming the Ni/P alloy, eliminating the hydrogen formed during the electrolytic process, so as to obtain a stable and homogeneous coating layer, minimising defects and internal stresses and further increasing hardness.

In this regard, the Applicant has observed that the process according to the invention allows, as a matter of fact, to avoid said heat treatment, since satisfactory properties of the coating are anyway obtained with no need to perform annealing processes. Therefore, according to a preferred embodiment the process according to the invention does not comprise a heat treatment of the article at the end of the electrodeposition. This clearly allows to significantly increase the productivity of the process, while reducing production costs.

Figure 2:
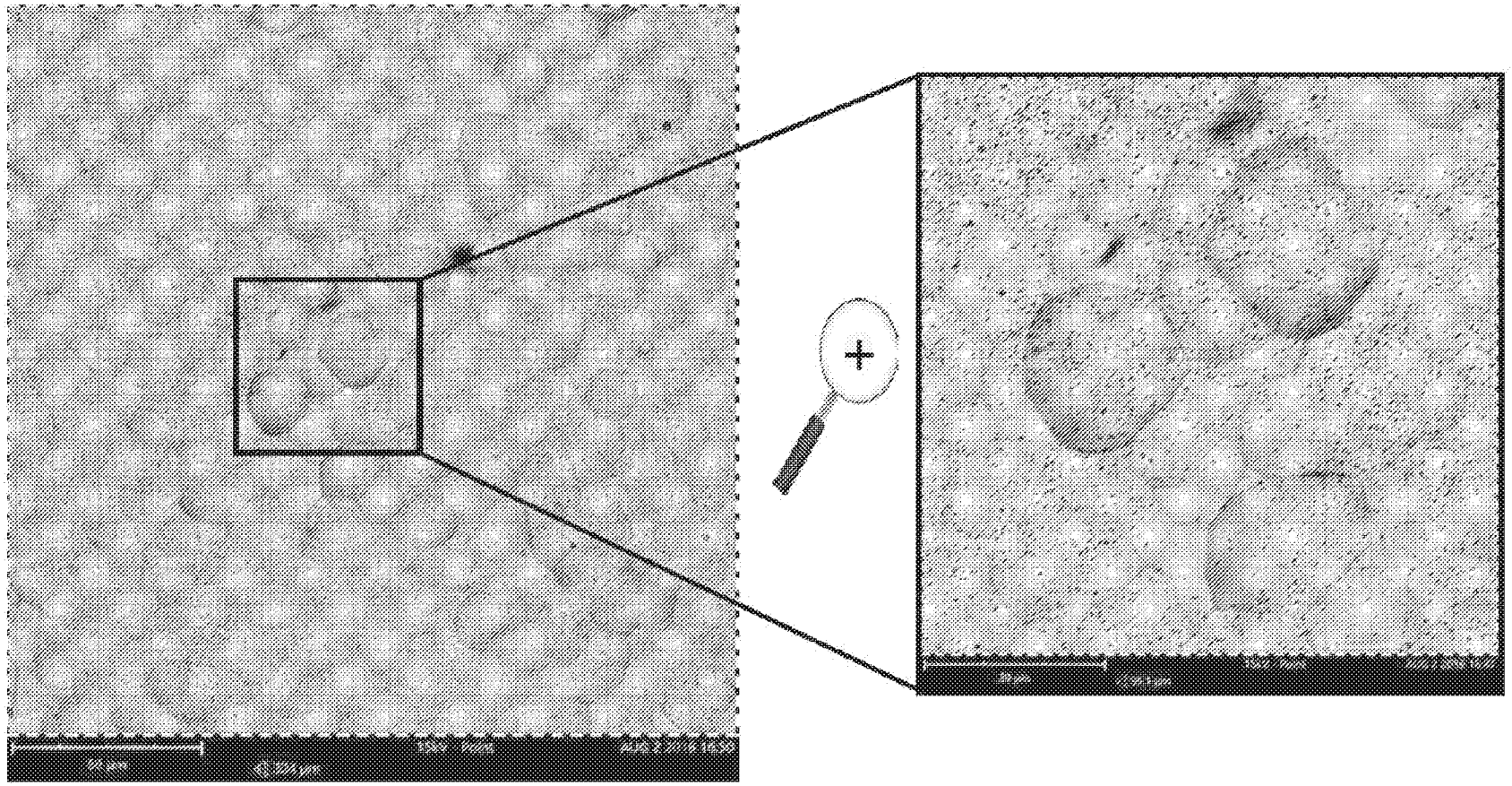

The present invention will now be further illustrated with reference to the figures accompanying the present description merely for exemplifying purposes, in which:

FIG. 1 shows a scanning electron microscope (SEM) microphotograph of a section of a coated sample according to the invention (200× magnification), where the black portion outside the coating layer is the resin in which the sample was incorporated, lapped and polished to perform the SEM analysis, while the underlying white part is the base metal on which electrodeposition was carried out; the presence of black particles consisting of boron carbide can easily be appreciated;

FIG. 2 shows a SEM microphotograph obtained on the same sample at front view, with an enlargement of a portion that highlights the typical mammillary structure of Ni/P alloys; the presence of black particles consisting of boron carbide can easily be appreciated.

The following working examples are provided merely to illustrate the present invention and should not be construed in a sense that would limit the scope of protection defined by the accompanying claims.

EXAMPLE 1

Boron carbide in the form of particles having average size of 0.4 μm was suspended, in a quantity of 10 g/l, in an aqueous phase having a pH value of 2.0 (obtained by adding a $H_2SO_4$ aqueous solution), containing 1 g/l of tartaric acid and 1 g/l of acrylic acid. The suspension thus obtained was maintained for about 1 hour in an ultrasonic sonicator at 60° C.

To the suspension was then added an aqueous solution consisting of:

| | |
|---|---|
| nickel sulphate (NiSO4 * $6H_2O$) | 75 g/l |
| phosphorous acid | 15 g/l |
| sodium hypophosphite | 40 g/l |
| sodium acetate ($CH_3COONa$) | 120 g/l. |

The electrolytic bath thus obtained was brought to a pH value of 2.0 with a $H_2SO_4$ aqueous solution.

The electrodeposition process was carried out on a steel plate, used as cathode, while the anode used was a titanium anode coated with mixed oxides. During the electrodeposition, the electrolytic bath was maintained for three hours at a temperature of about 80° C. and the current density at a value of about 10 A/dm$^2$.

At the end of the electrodeposition process, a coating layer of the plate was obtained with a thickness of about 25 μm, containing about 15% by weight in phosphorus, having Vickers hardness of 900 HV. It should be noted that such a high hardness was obtained without subjecting the specimen to a subsequent heat treatment (annealing) step, which is usually carried out for this type of coatings for the purpose of increasing its hardness.

On the specimen thus treated, corrosion resistance was measured in neutral saline fog, according to the ISO 9227: 2017 standard, obtaining a value of 1000 hour (rating: 10).

The sample thus coated was subjected to scanning electron microscope (SEM) analysis, and the microphotographs thus obtained are shown in FIG. 1 (section) and FIG. 2 (surface). The coating layer showed a substantially homogeneous distribution of boron carbide particles in the Ni/P matrix, with a mammillary surface structure that is typical of the Ni/P alloy.

EXAMPLE 2 (COMPARATIVE)

Example 1 was repeated in the same operating conditions, the only difference being that the boron carbide particles were not pre-treated with tartaric acid and acrylic acid, but rather used as such.

At the end of the electrodeposition process, a coating layer of the plate was obtained with a thickness of about 25 μm, containing about 15% by weight of phosphorus, having Vickers hardness of 550 HV (without annealing).

On the specimen thus treated, corrosion resistance was measured in neutral saline fog, according to the ISO 9227: 2017 standard, obtaining a value of 120 hours (rating: 8).

The invention claimed is:

1. A process for coating a metal article, the process comprising:

preparing an electrolytic bath comprising a suspension of boron carbide particles in an aqueous solution comprising:

at least one nickel (II) salt; and at least one phosphorous compound selected from: phosphoric acid, phosphorous acid, hypophosphorous acid, or their salts; and immersing, in the electrolytic bath, a cathode and an anode, and carrying out electrodeposition by passing direct current in the electrolytic bath;

wherein the cathode comprises the metal article to be coated, wherein the boron carbide particles have an average size greater than or equal to 0.01 micron (μm) and less than or equal to 2 μm, wherein the boron carbide particles have been pretreated with at least one carboxylic acid or a derivative thereof, and wherein the at least one carboxylic acid or the derivative thereof has a solubility in water at 20° C. greater than 0.10 grams/liter.

2. The process of claim 1, wherein the at least one carboxylic acid or the derivative thereof has a solubility in water at 20° C. greater than 10 grams/liter.

3. The process of claim 1, wherein the at least one carboxylic acid or the derivative thereof is selected from:

(i) aliphatic and/or aromatic $C_1$-$C_8$ mono-carboxylic acids;

(ii) aliphatic and/or aromatic $C_1$-$C_{12}$ di-carboxylic acids; or (iii) derivatives thereof.

4. The process of claim 3, wherein the aliphatic and/or aromatic $C_1$-$C_8$ mono-carboxylic acids are mono-hydroxylated, poly-hydroxylated, or mono-hydroxylated and poly-hydroxylated.

5. The process of claim 3, wherein the aliphatic and/or aromatic $C_1$-$C_8$ mono-carboxylic acids comprise one or more of formic acid, acetic acid, propionic acid, butyric acid, valerianic acid, capronic acid, enantic acid, caprylic acid, nonanoic acid, capric acid, acrylic acid, or methacrylic acid.

6. The process of claim 3, wherein the aliphatic and/or aromatic $C_1$-$C_{12}$ di-carboxylic acids are mono-hydroxylated, poly-hydroxylated, or mono-hydroxylated and poly-hydroxylated.

7. The process of claim 3, wherein the aliphatic and/or aromatic $C_1$-$C_{12}$ di-carboxylic acids comprise one or more of oxalic acid, adipic acid, phthalic acid, azelaic acid, sebacic acid, tartaric acid, or aldaric acid.

8. The process of claim 1, wherein the boron carbide particles have been pretreated with a mixture of tartaric acid and acrylic acid.

9. The process of claim 8, wherein a weight ratio between the tartaric acid and the acrylic acid is greater than or equal to 0.2:1 and less than or equal to 5:1.

10. The process of claim 1, wherein the boron carbide particles have been pretreated by suspending the boron carbide particles in water and adding the at least one carboxylic acid or the derivative thereof to the suspension thus obtained.

11. The process of claim 10, wherein the at least one carboxylic acid or the derivative thereof is added to the suspension of boron carbide particles in an amount greater than or equal to 1% by weight and less than or equal to 40% by weight with respect to a weight of the boron carbide particles.

12. The process of claim 1, wherein the boron carbide particles have been pretreated at temperature greater than or equal to 30° C. and less than or equal to 90° C., for time greater than or equal to 20 minutes and less than or equal to 120 minutes.

13. The process of claim 1, wherein the boron carbide particles have an average size greater than or equal to 0.05 μm and less than or equal to 1 μm.

14. The process of claim 1, wherein the boron carbide particles are purified before the boron carbide particles have been pretreated with the at least one carboxylic acid or the derivative thereof.

15. The process of claim 1, wherein the aqueous solution comprises Ni(II) ions in total concentration greater than or equal to 0.3 moles/liter and less than or equal to 3.0 moles/liter.

16. The process of claim 1, wherein the at least one phosphorous compound is a mixture of phosphorous acid with hypophosphorous acid, phosphorous acid with one or more salts or hypophosphorous acid, one or more salts of phosphorous acid with hypophosphorous acid, or one or more salts of phosphorous acid with one or more salts or hypophosphorous acid.

17. The process of claim 1, wherein pH of the aqueous solution is greater than or equal to 0.5 and less than or equal to 4.

18. The process of claim 1, wherein the electrodeposition is carried out for a time so as to obtain a coating thickness greater than or equal to 5 μm and less than or equal to 200 μm.

19. The process of claim 1, wherein the boron carbide particles have been pretreated at temperature greater than or equal to 40° C. and less than or equal to 80° C., for time greater than or equal to 40 minutes and less than or equal to 80 minutes.

20. The process of claim 1, wherein the electrodeposition is carried out for a time so as to obtain a coating thickness greater than or equal to 10 μm and less than or equal to 75 μm.

* * * * *